United States Patent [19]

Lemasson

[11] Patent Number: 4,942,702

[45] Date of Patent: Jul. 24, 1990

[54] PRE-FABRICATED PANEL FOR BUILDING, PARTICULARLY FOR BURIAL VAULTS

[76] Inventor: Paul Lemasson, La Cappe, Cedex 2121, Genilac F-42800, France

[21] Appl. No.: 309,794

[22] PCT Filed: May 11, 1988

[86] PCT No.: PCT/FR88/00236

§ 371 Date: Jan. 11, 1989

§ 102(e) Date: Jan. 11, 1989

[87] PCT Pub. No.: WO88/08912

PCT Pub. Date: Nov. 17, 1988

[30] Foreign Application Priority Data

May 12, 1987 [FR] France ..... 88 07003

[51] Int. Cl.[5] ..... E04H 13/00; E04C 2/26

[52] U.S. Cl. ..... 52/127.7; 52/142; 52/309.12; 52/405; 52/584; 52/593

[58] Field of Search ..... 52/142, 141, 309.12, 52/405, 593, 584, 787, 136, 98, 127.7

[56] References Cited

U.S. PATENT DOCUMENTS

| | | | |
|---|---|---|---|
| 860,282 | 7/1907 | Crew | 52/142 |
| 952,985 | 3/1910 | Ernsberger | 52/136 |
| 1,486,152 | 3/1924 | Mascio . | |
| 3,732,831 | 5/1973 | Marciniak et al. | 109/83 |
| 4,021,979 | 5/1977 | Rez | 52/142 |
| 4,044,511 | 8/1977 | Lingle | 52/584 |
| 4,291,513 | 9/1981 | Ankarswed | 52/405 |

FOREIGN PATENT DOCUMENTS

| | | |
|---|---|---|
| 1912116 | 9/1970 | Fed. Rep. of Germany . |
| 2307079 | 10/1974 | Fed. Rep. of Germany . |
| 2308750 | 11/1976 | France . |

*Primary Examiner*—John E. Murtagh

*Attorney, Agent, or Firm*—Steele, Gould & Fried

[57] ABSTRACT

This panel is outstanding in that each panel is made up of a plate (1) of insulating material inserted during moulding between two layers of cement (2) and (3) of different density and thickness, the transversal faces of the end of each panel being fitted in combination in order to enable their axial alignment positioning or angular positioning at 90° while being fitted with fixing components apt to provide their assembly into position, the said panels being also designed in order to cooperate and be centered with a bottom plate and/or plate acting as a cover.

8 Claims, 2 Drawing Sheets

PRE-FABRICATED PANEL FOR BUILDING, PARTICULARLY FOR BURIAL VAULTS

The object of the invention relates to the technical sector of building components and materials.

The aim sought after is to be able to produce a construction, in a simple and quick way, from standard, pre-fabricated components designed so as to be mounted and assembled by anyone and not requiring any particular qualification. In an advantageous manner which could not be considered as strictly limitative, the components or pre-fabricated panels are more particularly adapted for constructions having to be either totally or partially buried. This is particularly the case for burial vaults where, firstly, the walls should be totally sealed and secondly, withstand earth pressures.

Via the French Patent 2.308.750, pre-fabricated panels composed of an intermediate plate made of an insulating material inserted between two external concrete plates are known. Built-up components provide the assembly of different plates between one another.

Given these conditions, the different plates are not closely connected, so that once produced, the panels can only be applied in the event of aboveground constructions and in no circumstances for constructions either fully or partially buried. In addition, no means and/or fitting is provided to enable the assembly of the different panels between one another.

In order to solve the problem brought up, that is to have pre-fabricated panels, more particularly, apt to be buried, according to the invention, each panel is made up of a plate made of an insulating material inserted, on moulding, between two layers of cement of different density and thickness, the external layer being very slighted crowned, the transversal faces of the end of each panel being fitted in combination in order to allow for their axial alignment or angular positioning at 90° by being fitted with means which are apt in order to provide their assembly into position, the said panels being, in addition, designed so as to cooperate and be centred with a bottom plate and/or plate which is used as a cover.

The invention is now described with the aid of the drawings which only represent one embodiment.

Figure 1:
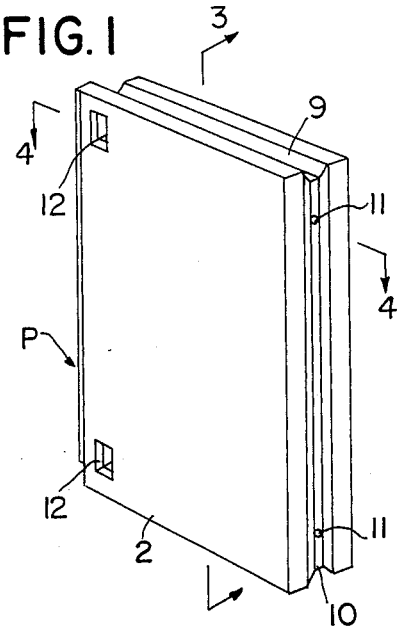
FIG. 1 is a perspective view of a first type of panel.

The object of the invention will become more apparent from the following non limiting detailed description when considered in conjunction with the accompanying drawings.

Each component or panel, described as an assembly as (P) is made up of a plate (1) of an insulating material inserted during moulding, between two layers of cement (2) and (3) corresponding to the internal and external walls of the panel respectively. The two layers (2) and (3) are a different density and thickness.

Layer (2) corresponding to the internal wall with a density and thickness greater than layer (3) corresponding to the external wall. This external wall (3) is thinner and is very slightly crowned in order to withstand possible deformations.

Metal reinforcements (4) are sunk into each of layers (2) and (3). The insulating plate (1) is generally rectangular shaped and made of expanded polystyrene for example.

According to another characteristic, the edges of each panel are designed in order to be self-positioned, firstly between one another and secondly, in combination with one or several bottom components (5) and one or several of components (6) acting as a cover.

With this in mind, the transversal faces of the ends, have, provided vertically and complementary, on one side a profiled rib (7) and a groove (8) on the other. These ribs and grooves are formed when the layers of cement are poured. In the same way, the top and bottom horizontal edges of each panel have grooves (or ribs) (9) and (10), destined to cooperate with complementary ribs (5*a*) and (5*b*) (or grooves) formed along the peripheral edges of the bottom (5) and the cover (6).

Figure 2:
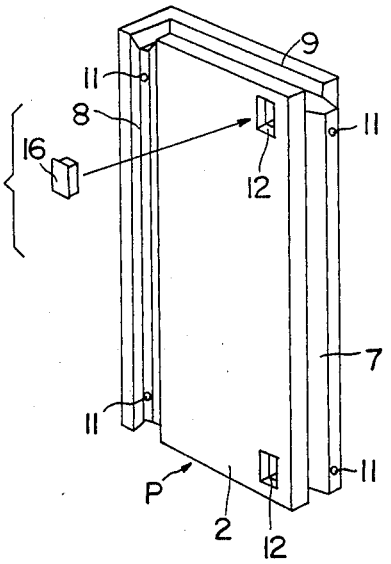
FIG. 2 is a perspective view of a second type of panel.
Figure 3:
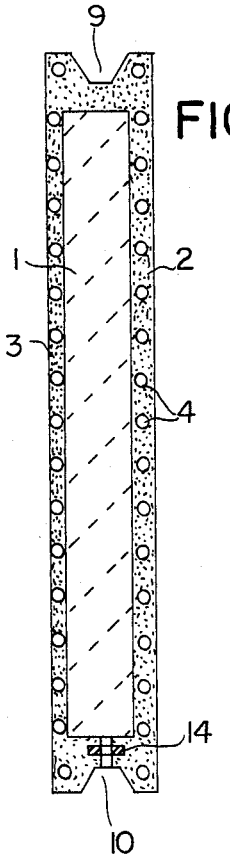
FIG. 3 is a sectional view taken along the line 3—3 of FIG. 1.
Figure 4:
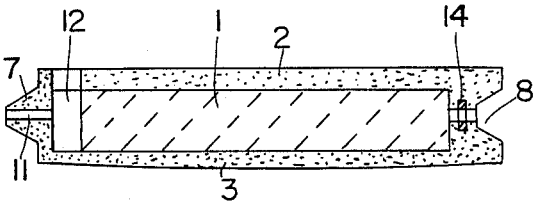
FIG. 4 is a plan and sectional view taken along the line 4—4 of FIG. 1.

As FIGS. 1 and 2 show in particular, the panels are mainly of two types, i.e. the intermediate panels (FIG. 1) and the corner panels (FIG. 2). As far as the intermediate panels are concerned, the complementary assembly grooves and ribs (7) and (8) are arranged according to the same axial alignment. In order to make up the corner panels, the grooves and ribs (7) and (8) are angularly offset by 90°, one of the grooves or ribs being formed on one of the side faces of the panel, close to one of the transversal edges and parallel to the latter.

It is also anticipated to fit the transversal edges of each panel along with their top and bottom edges with means and fittings likely to provide their assembly in a close joining position and their assembly with the bottom components and the cover.

With this aim, in the thickness of all of the panels, perpendicular to the centering grooves or ribs of one of the vertical edges, there are breaking through holes (11) which correspond with access openings (12) formed in the thickness of the internal layer of cement of the insulating plate (1). These holes (11) are destined to take bolt type assembly components (13) likely to cooperate with nuts or other inserts (14) sunk into the thickness of an adjacent panel, axially opposed to the edge taking the said bolt.

Obviously, the fittings made close to the vertical edges of the panels, i.e. the access openings (12) corresponding with the holes (11) to enable the passage of the fixing components (13), can also be formed close to the top and bottom horizontal edges. Plugs (16) are positioned in any known manner, in the openings (12).

Figure 6:
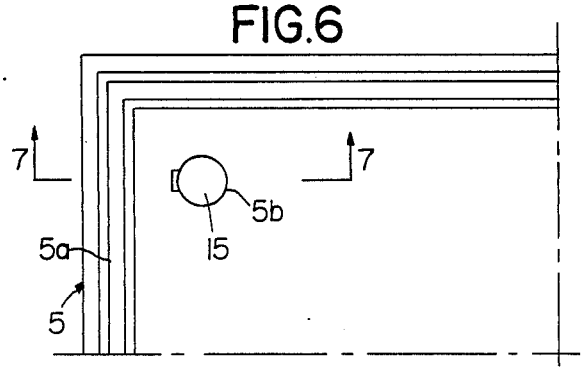
FIG. 6 is a partial, plan view of the bottom plate.
Figure 7:
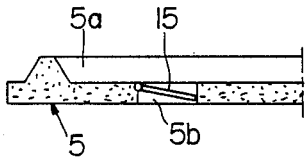
FIG. 7 is a sectional view taken along the line 7—7 of FIG. 6.

The thickness of the bottom plate (5) FIG. 6, made of one or several components, has at least one hole (5*b*) likely to be temporarily blocked by a swinging flap (15). This flap is pivot mounted in a downward direction whilst being fixed to a counterweight system in order to maintain the hole in the closed and blocked position. The bottom plate(s) (5) is/are solid and made of cement for example.

In the case of a burial vault, the hole (5*b*) is provided to evacuate gases, the flap preventing water to go back up on the inside. Regarding the cover (6), this can be made in two parts with an opening by swinging or in one piece with an opening by means of sliding. In both cases, the assembly is locked and closed by a key. A seal or suchlike (not represented) provides sealing.

Figure 8:
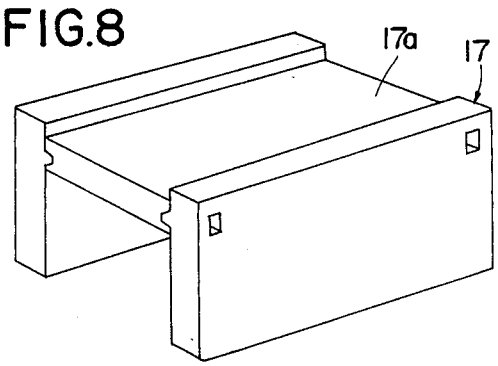
FIG. 8 is a perspective view, illustrating a support produced with the components according to the invention.
Figure 5:
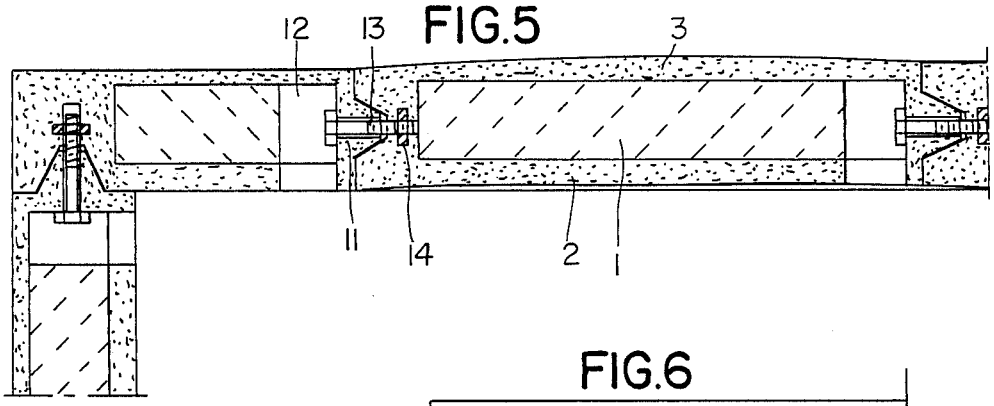
FIG. 5 is a sectional view showing the assembly of several components side by side.
Figure 9:
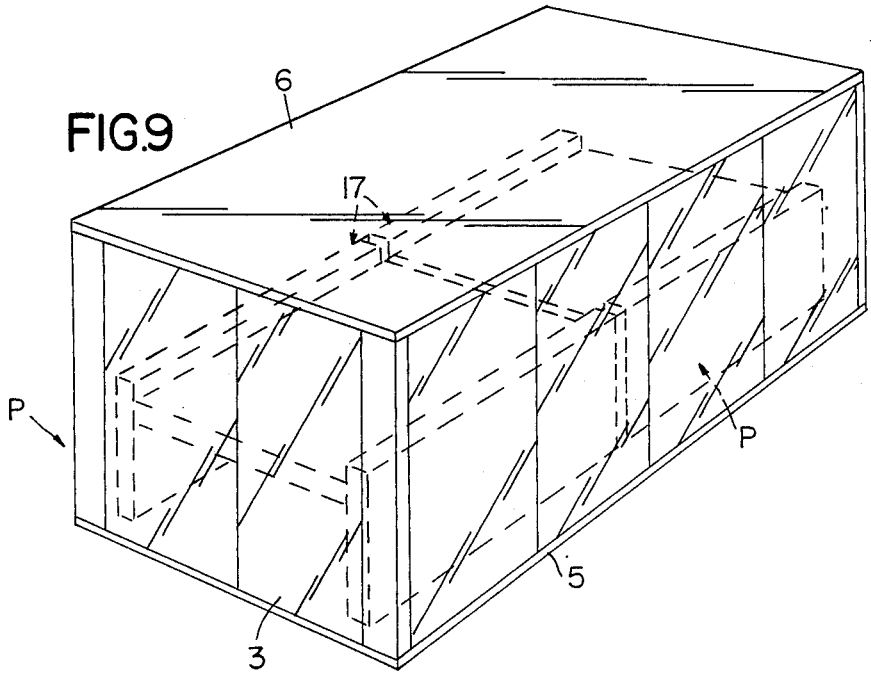
FIG. 9 is a perspective view showing a burial vault produced with the components according to the invention and fitted with supports according to FIG. 8.

As illustrated in FIGS. 8 and 9, production is anticipated with the components of the type described, ie. with an insulating material inserted between two layers of cement, supports (17), destined to take one or several coffins on their top face (17*a*). According to the dimensions of the burial vault, 1, 2, or 4 supports could thus be anticipated in order to house 2, 4 or 8 coffins in the burial vault.

The invention finds many applications amongst which it would be worth noting the following besides burial vaults—garden shelters, garages, worksite huts, wine cellars etc. According to the applications envisaged, the panels have openings.

The advantages are made clearly apparent by the description and the following can be underlined in particular:

the rapidity and simplicity of assembly by any non-qualified person the possibility of producing a burial vault in a short space of time with a minimum manufacturing cost.

I claim:

1. Pre-fabricated panel for the construction of burial vaults in particular, wherein each panel is made up of a plate (1) of insulating material inserted during moulding, between two layers of cement (2) and (3) of different density and thickness, the external layer (3) being very slightly crowned, the transversal faces of the end of each panel being fitted in combination in order to enable their axial alignment positioning or angular positioning at 90° whilst being fitted with means apt in order to provide their assembly into position, the said panel being also designed in order to cooperate and be centered with a bottom plate (5) and/or a plate acting as a cover (6).

2. Panel according to claim 1, wherein the layer (2) corresponding to the internal wall, has a greater density and thickness to those of the layer (3) corresponding to the external wall.

3. Panel according to claim 1, wherein metal reinforcements are sunk into each of the layers.

4. Panel according to claim 1, wherein the fittings of the end transversal faces have, in a complementary manner, on one side, a vertical, profiled rib (7) and on the other, a groove (8), the said ribs and grooves being formed when the cement of the layers is poured.

5. Panel according to claim 4, wherein the complementary grooves and ribs (7) and (8) are arranged according to the same axial alignment.

6. Panel according to claim 4, wherein the complementary grooves and ribs (7) and (8) are angularly offset by 90°, one of the grooves or ribs being formed on one of the side face of the panel, close to the transversal edges.

7. Panel according to claim 1, wherein the assembly means are made up of one or several breaking through holes (11) perpendicularly formed from at least one of the transversal edges, the holes corresponding with access holes (12), formed in the thickness of the external layer of cement, the said holes being likely to take fixing components (13) likely to cooperate with inserts (14) sunk into the thickness of an adjacent panel, axially opposed to the edge taking the fixing component(s) (13).

8. Panel according to claim 7, wherein the access openings (12) corresponding with the holes (11) in order to provide the passage of the fixing components (13), are also formed close to top and/or bottom horizontal edges.

* * * * *